United States Patent [19]

Hughes

[11] 4,366,928

[45] Jan. 4, 1983

[54] APPARATUS AND METHOD FOR COMMINUTING SOLID MATERIALS

[76] Inventor: John H. Hughes, 458 Wynooche Rd., Montesano, Wash. 98563

[21] Appl. No.: 166,232

[22] Filed: Jul. 7, 1980

[51] Int. Cl.[3] ..... B02C 18/12

[52] U.S. Cl. ..... 241/30; 241/245; 241/253; 241/257 R; 241/261

[58] Field of Search ..... 241/30, 251, 253, 257 R, 241/258, 261, 246, 188 R, 190, 252, 228, 186 R, 27, 245, 299, 154, 161

[56] References Cited

U.S. PATENT DOCUMENTS

| | | | |
|---|---|---|---|
| 3,166,301 | 1/1965 | Wootten | 241/261 X |
| 3,356,016 | 12/1967 | Eidal | 241/188 R X |
| 3,851,829 | 12/1974 | Dopper et al. | 241/188 R |
| 4,120,458 | 10/1978 | Hughes | 241/186 R |

*Primary Examiner*—Mark Rosenbaum
*Attorney, Agent, or Firm*—Christensen, O'Connor, Johnson & Kindness

[57] ABSTRACT

In an apparatus and method for comminuting solid material a plurality of comminuting rollers are journalled for rotational motion in a generally circular arrangement to form a tubular enclosure. Solid pieces of material introduced into the enclosure are driven orbitally at a speed sufficient to be forced centrifugally outwardly against the comminuting rollers. Puncturing elements on the rotating rollers operate to comminute the pieces of material by a rolling, puncturing action. In a preferred embodiment, the rollers are powered and are rotated conjointly to engage and drive the solid material orbitally. Additionally, an impeller may be employed to drive the material within the enclosure, and in yet another embodiment, the entire enclosure, including the rollers, is rotated.

41 Claims, 12 Drawing Figures

APPARATUS AND METHOD FOR COMMINUTING SOLID MATERIALS

BACKGROUND OF THE INVENTION

The present invention relates generally to comminutors, sizing refiners and other machines for comminuting solid materials and, more particularly, to comminuting machines employing multiple rollers as the operative comminuting elements.

A wide variety of machines are known in industry for comminuting various types of solid material. Special purpose comminutors are known for comminuting diverse materials including coal, rock, wood, ore and refuse. For example, in the paper and pulp industries, comminutors commonly referred to as sizing refiners are employed to comminute wood waste to a size suitable for pulping. Other types of comminutors are used to produce wood chips for use in particle board. In the construction industry, heavy-duty comminutors of various types are used to produce crushed rock for use as gravel in concrete or in other construction applications. In the mining industry, ores are crushed to effect mineral separation in preparation for chemical or mechanical processing. Special purpose comminutors are employed in modern waste disposal facilities for comminuting garbage and solids in sewage prior to disposal or treatment.

One disadvantage of conventional comminutors is that they must be substantially overpowered to accommodate occasional overloading caused by relatively large or hard pieces of material fed into the machine. For example, in rock crushing machines having reciprocating jaw crushers, the machine must be sufficiently powerful to accommodate occasional overloading caused by a number of like-sized, relatively large rocks being fed at once into the jaws when the jaws are at a postion of maximum extension and thereby obtain a minimum of mechanical advantage in acting upon the rocks. Binding and jamming of the machine results if the machine is unable to crush the rocks under such circumstances. To avert this possibility, such machines are generally provided with a heavy-duty motor that can meet the occasional high power demands. The occasional peak power levels of such machines are much greater than their ordinary operating power levels, with the result that the external power supply to the comminutor must have an inordinately large peak power capacity. Where such comminutors are electrically powered, this requires high-power electrical hook-ups which are increasingly costly and difficult to obtain in many areas. The high peak power requirements of such comminutors also increase the size and expense of the structural components of the comminutors.

The above-mentioned problem is further aggravated by the fact that in most comminutors the material is constrained to pass through the machine at a relatively constant feed rate regardless of the force necessary to reduce it. This limits the capacity of the machine to process solid materials of varying hardness and size and also increases the likelihood of overloading and jam Another common disadvantage of conventional comminutors is the high cost of repair and maintenance, particularly in the case of comminutors having comminuting elements which employ a cutting, shearing or chopping action. Such comminutors are typically used to comminute softer materials such as wood or refuse. Periodic maintenance and sharpening of the comminuting elements is necessary to keep the machine in satisfactory operating condition. Repairs are frequently necessitated by damage to the comminuting elements caused by inadvertent introduction of hard foreign objects into the machine. When such damage occurs, it is often extensive and is both difficult and costly to repair.

Further, many comminutors provide poor control over the consistency of the refined product. Specifically, a substantial portion of the comminuted material is often comminuted to an unnecessarily small size by overcomminuting or repeated comminuting of the same material. This results in a comminuted product having a large variation in particle size distribution, particularly in the smaller size ranges. Also, such unnecessary comminuting increases the energy consumption and overall cost of the process.

An example of a contemporary comminutor adapted particularly for comminuting wood waste is disclosed in the U.S. Pat. No. 4,120,458 to Hughes. The comminutor disclosed therein includes a plurality of toothed sprockets journalled substantially horizontally in the floor of an upright rotatable drum enclosure. In operation, solid material is introduced into the rotating drum enclosure and is driven in an orbital motion by engagement by a number of inwardly projecting vanes affixed to the inside of the drum. The weight of the rotating mass of material being upon the toothed sprockets causes the material to be reduced and comminuted until it is of a sufficiently small size to pass between the sprockets and out of the enclosure. Although this comminutor has proved to be adequate for its intended purposes, it is an object of the present invention to provide an improved comminutor whereby greater and more efficient forces may be brought to bear upon the solid material being comminuted. More specifically, it is an object of the present invention to provide a comminutor wherein the force with which solid material is driven against a set of comminuting elements is not limited to the force of gravity.

Accordingly, the general object and purpose of the present invention to provide an improved comminutor that is energy efficient and operates at a relatively constant power level.

It is also an object of the present invention to provide a comminutor that is of general applicability to solid materials of varying size, shape and hardness.

It is another object of the present invention to provide a comminutor that requires minimal maintenance and repair, and which is easily serviced and repaired when necessary.

It is yet another object and purpose of the present invention to provide a comminutor that screens the solid material, allowing only particles sufficiently reduced to be discharged, and yet which also avoids repeated comminuting or over-comminuting of material already sufficiently reduced.

It is also an object to provide a comminutor wherein exceptionally large or hard pieces of solid material are retained in the machine and continuously processed until sufficiently comminuted, without impairing or restricting the flow of other material through the comminutor.

It is yet another object of the present invention to provide a comminutor that allows close control over the size distribution of the comminuted product.

SUMMARY OF THE INVENTION

In accordance with the present invention, a comminutor includes a plurality of rollers journalled to a suitable frame and arranged to form an upright tubular enclosure. Serially adjacent rollers are slightly spaced from one another and aligned with their axes of rotation substantially parallel. The rollers are preferably arranged in a circle to form a cylindrical enclosure. The rollers are preferably provided with outwardly projecting puncturing elements that operate in the manner described in greater detail below to comminute material by a combination puncturing and tearing action. A drive means is provided to cause solid material introduced into the enclosure to be swirled in an orbital motion so as to be dashed against the rollers and comminuted by a rolling puncturing action against the rollers until the material is sufficiently divided to be passed out of the enclosure through discharge openings in the base of the enclosure or between the rollers.

Various means may be employed to drive the solid material in an orbital motion. In the preferred embodiment, for example, the rollers are journalled at their opposite ends in a stationary frame and are driven at a sufficient rotational speed to engage the solid material adjacent the rollers within the enclosure and impart it to an orbital motion. In this embodiment the puncturing elements on the rollers or the rollers themselves operate by their tangential motion to grasp the material and drive it orbitally within the enclosure and, further, to comminute the material by a combination of a puncturing action and an avulsing or tearing action as the material is urged outwardly by centrifugal force against the puncturing elements of the rotating rollers.

It is the orbital motion of the mass of material that creates the centrifugal force which drives the material radially outwardly to effect a puncturing action against the rollers. Additionally, a tearing or avulsing action arises because there is invariably a certain amount of drag or inertial momentum of the solid material that results in the material having a lesser tangential velocity along the inside periphery of the enclosure than that of the rollers. Consequently, where the rollers have outwardly projecting teeth or other cutting elements, such elements comminute the material by the puncturing action induced by the centrifugal force of the material as well as by the tearing action resulting from the different tangential speeds between the cutting elements and the solid pieces of material.

Additionally, there is an agitative action created by the pieces of solid material being driven outwardly against the interstices between adjacent rotating rollers. Within the interstices between adjacent rollers the tangential motions of such rollers and their respective cutting elements are in opposite directions, with the result being that pieces of solid material coming into contact with two adjacent rollers are given a spinning rotational motion that is in addition to their orbital motion within the enclosure. This spinning rotational motion enhances the avulsing interaction between the rollers and the pieces of material and also results to some extent in a comminuting or grinding interaction between individual pieces of solid material that is independent of the interaction between the rollers and the pieces of material.

It will be apparent that increasing the rotational speed of the rollers results in a greater orbital velocity of the solid material, with resulting greater puncturing action as well as avulsing or tearing action. Thus, the speed of the rollers will ordinarily be selected on the basis of the type of material being comminuted as well as, to some extent, the desired consistency of the comminuted product.

In another embodiment, the entire frame, including the rollers, is rotated. The comminuting rollers may be freely journalled to the rotating frame or they may be also driven independently of the frame. By selectively varying the absolute as well as the relative rotational speeds of the frame and the rollers, a great variety of comminuting actions may be obtained. Specifically, for example, when the rollers are rotated in a direction contrary to the direction of the frame the rotational motion of the rollers act to augment their oribtal motion about the circumference of the enclosure to thereby give the inwardly facing portions of the rollers a great tangential or orbital velocity than could be attained by rotating either the frame or the rollers alone, thus imparting a greater obital speed, and thus also a greater centrifugal force, to the material being comminuted in the enclosure. The greater centrifugal force obtained in this manner increase the puncturing action of the puncturing elements of the rollers without also necessarily increasing the avulsing action of the elements. This enables selection of the particular type of comminuting action desired, with different types of actions being employed for different types of materials. For example, in the comminution of wood waste for reduction to pulp, it may be desirable to employ a greater tearing or avulsing action as opposed to the puncturing action. Likewise, in the case of rocks or other hard materials it will often be desirable to employ a greater relative puncturing action than avulsing action because of the improved comminuting efficiency that can thereby be obtained.

In another embodiment, orbital motion is imparted to the solid material by means of a powered rotatable impeller centered in the enclosure. Such an impeller may be used as the sole means of swirling the solid material within the enclosure, or it may be employed in combination with either of the embodiments described above. For example, in the simplest embodiment the rollers are journalled to a stationary frame for free rotation and the impeller is employed to drive material in the enclosure in an orbital motion against the rollers. Alternatively, the rollers may be also powered, as in the embodiments described above. In this embodiment the velocity of orbital motion of the solid material may be varied both absolutely and also relative to the tangential velocity of the teeth of the comminuting rollers. For example, in such an embodiment the impeller could even be rotated in a direction contrary to that of the rollers to achieve a maximum avulsing action as the puncturing elements of the rollers sweep across the solid material in a direction opposite to the direction imparted to the material by the impeller. In yet another application of this embodiment, the rollers may be rotated with a speed and in a direction coordinated with that of the impeller so as to result in the inner tangential velocity of the rollers being the same as that of the material driven by the impeller, thus resulting in practically no avulsing action and almost complete puncturing action by the cutting elements upon the swirling material.

In yet another embodiment, all three of the above described embodiments are combined in a comminutor wherein the frame, rollers and impeller are all independently powered. This embodiment gives the greatest control over the type of comminuting action obtained, since the rotational speed of each of the rotating elements may be separately varied.

In all of the foregoing embodiments, the relative sizes and numbers of rollers may also be varied to achieve different comminuting actions. For example, having fewer but larger rollers results in a comminutor wherein the rollers exert greater forces of impact on the pieces of solid materials and wherein the pieces of material impact the surfaces of the rollers at relatively greater angles of incidence between the surfaces of the rollers and the orbiting pieces of material. Conversely, having a greater number of smaller rollers results in a greater frequency of impacts each having a lower angle of incidence and a relatively lesser force of impact.

As mentioned above, a primary advantage of the various embodiments of the present invention arises from the ability to vary the velocity of orbital motion of the solid material and thereby vary the centrifugal force with which the material is dashed against the comminuting rollers. Further, this advantage is obtained without any restrictions on the sizes or types of materials that may be comminuted. Thus, it is possible to select an optimum orbital speed for any particular type of material that results in optimum processing of the material. Moreover, the relative puncturing and avulsing actions of the comminuting elements may be varied to achieve an optimum control over the quality of the comminuted product.

In another aspect of the invention, gear-like clusters of teeth are spaced along the shafts of the rollers. The clusters of teeth of adjacent rollers are mutually interleaved such that the outer edges of the teeth of one roller rotate immediately adjacent the shaft portion between the clusters of teeth of the adjacent roller. Preferably, in this embodiment of the invention, the teeth are each of the configuration of a vertically oriented triangular prism having an outwardly directed cutting edge. By interleaving the clusters of teeth, the rollers and teeth form an essentially impermeable enclosure whereby comminuted solid material can be discharged from the enclosure between the rollers only upon being reduced to a particulate airborne state wherein it passes through the rollers in the gaps between adjacent teeth. Preferably, however, where very fine reduction of the solid material is not necessary or desirable, discharge recesses are located in the base of the comminutor at the ends of the rollers. Overlying the recesses, or set into the recesses, are lowermost clusters of teeth which act as screening elements to pass sufficiently comminuted material downwardly into the recesses and out of the enclosure.

It will be seen that the comminuting action of the present invention on solid pieces of material is largely independent of the sizes of the pieces of material. Larger pieces of material introduced into the enclosure simply undergo a longer period of comminuting until they are sufficiently reduced to pass out of the enclosure, without impairing the flow of other, smaller pieces of material through the comminutor. Thus, the comminutor of the present invention readily processes solid material having a large size distribution. Likewise, the comminutor readily accepts and processes mixed solid material objects having different hardnesses, with the harder objects merely undergoing longer periods of comminuting before they are sufficiently reduced to pass out of the enclosure.

The invention also encompasses the method of reducing solid material objects wherein a mass of such objects is driven in an orbital motion confined by bearing contact with an annular array of rollers having puncturing elements distributed thereon. Centrifugal force arising from the orbital motion of the solid objects causes them to bear forcibly upon the puncturing elements of the rollers to be comminuted and reduced until they are of a sufficiently small size to pass out of the enclosure.

The present invention also encompasses the methods embodied in the above-described embodiments of the invention, particularly including the method whereby solid material is comminuted by driving it in an orbital motion against comminuting elements to achieve a rolling puncturing action.

A further understanding of the advantages and purposes of the present invention may be obtained by reference to the accompanying drawings and the following detailed description of the preferred embodiment.

DETAILED DESCRIPTION OF THE PREFERRED EMBODIMENT

Figure 1:
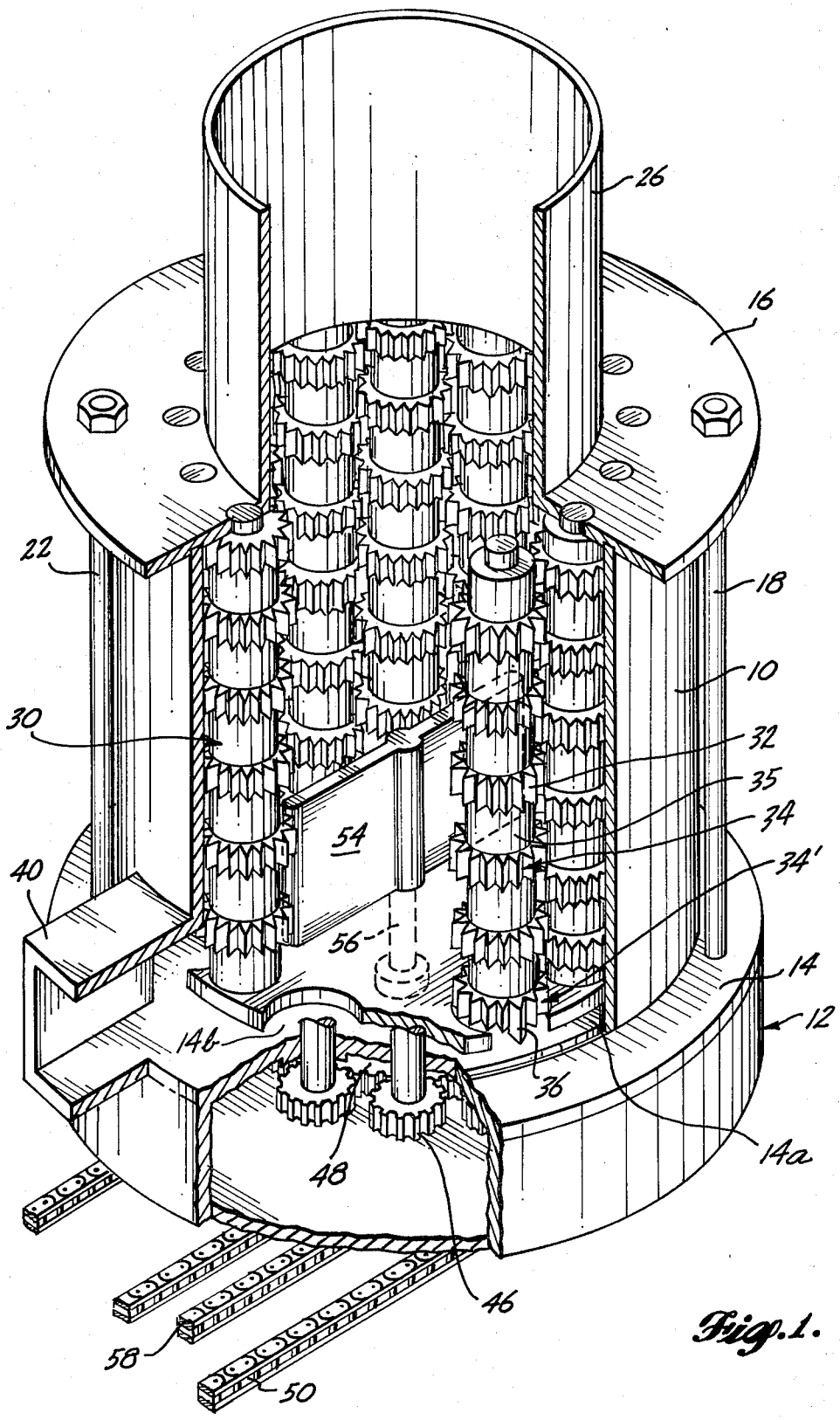
FIG. 1 is an isometric view in partial cross section of the preferred embodiment of the comminutor of the present invention.

Referring to FIGS. 1 through 4, the preferred embodiment of the comminutor of the present invention includes an upright cylindrical housing 10 mounted on a generally cylindrical base 12. The base 12 includes a circular base plate 14 on which the housing 10 rests. The housing 10 is clamped between the base plate 14 and an annular top plate 16 by means of four tie rods 18, 20, 22 and 24 which connect the base plate 14 and the top plate 16. A tubular infeed chute 26 is affixed to the central opening of the top plate 16 and extends upwardly therefrom.

In the preferred embodiment, sixteen toothed comminuting rollers 30 are journalled at their opposite ends for rotational motion to the top plate 16 and the base plate 14. The rollers 30 are journalled with their axes of rotation substantially parallel to one another and also parallel to the central axis of the cylindrical housing 10. The rollers 30 are positioned adjacent the interior cylindrical wall of the housing 10 and are equally spaced circumferentially about the inside of the housing 10 to form within the housing 10 a generally cylindrical enclosure bounded by the rollers 30 into which solid pieces of material may be introduced through the infeed chute 26.

The absolute and relative sizes of the housing 10, the infeed chute 26 and the rollers 30 are determined by the nature of the material to be comminuted and the desired size distribution of the final comminuted product. For example, the size of the infeed chute 26 with respect to the housing 10 is chosen such that the infeed chute 26 operates to limit the sizes of pieces of material that may be introduced into the enclosure to those which may be adequately processed by the machine. As an example of the overall size of the comminutor, it is found that a comminutor having a housing diameter of about four to six feeth, and also having rollers 30 and an infeed chute 26 sized respectively according to the scale illustrated in the FIGURES, is sufficient for comminuting wood scraps (end cuts) from a sawmill.

In the illustrated preferred embodiment, each roller 30 includes integral, radially outwardly projecting teeth 32 arranged in gear-like clusters or rings 34 about a central shaft portion 35. The teeth 32 are each of the form of an upright triangular prism oriented with one upright cutting edge directed radially outwardly away from the axis of the roller 30.

Figure 2:
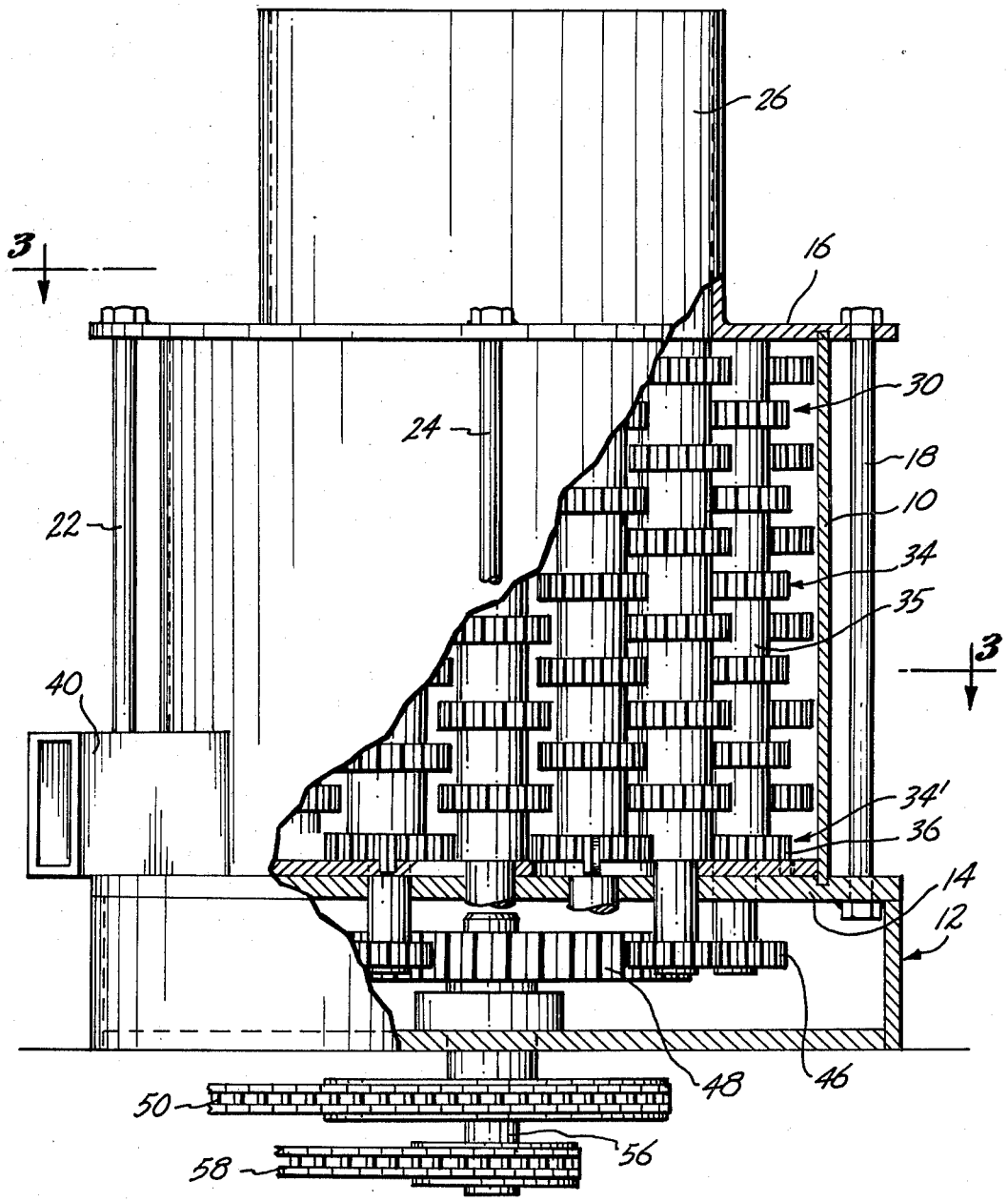
FIG. 2 is a side view in partial cross section of the comminutor of FIG. 1.
Figure 3:
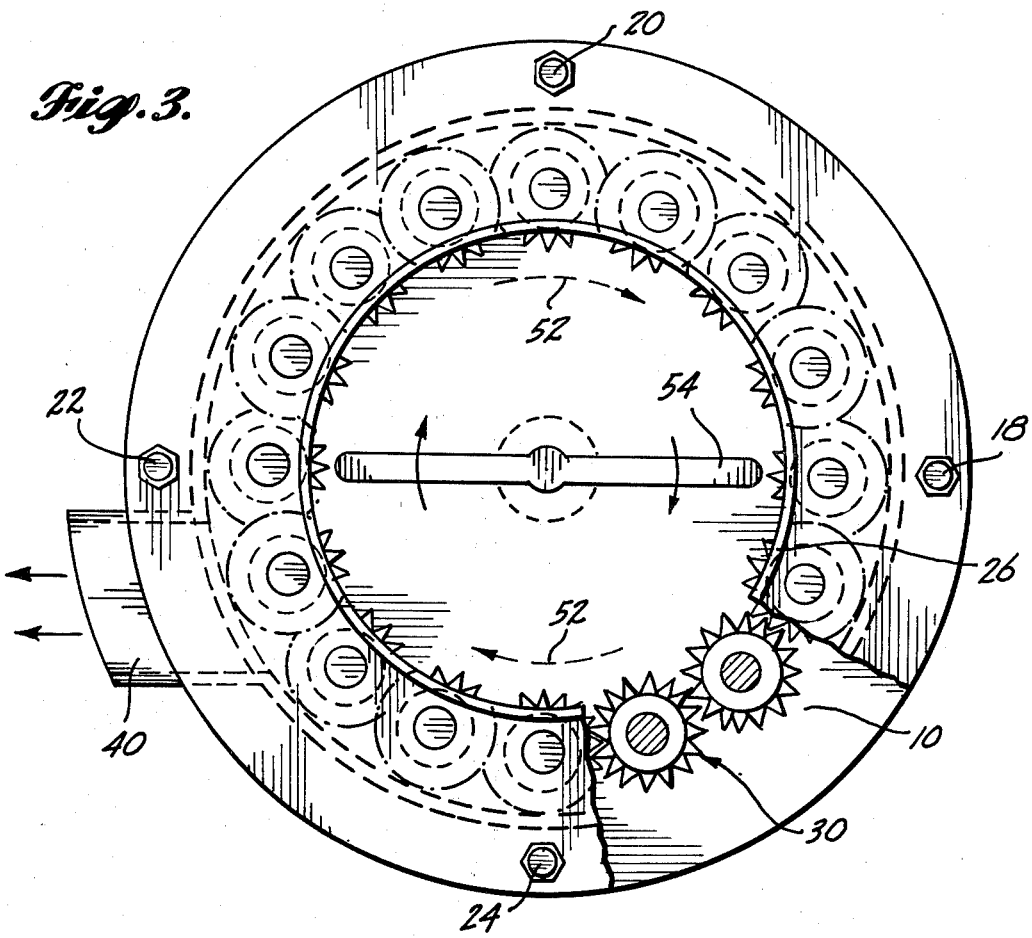
FIG. 3 is a plan view in cross section of the comminutor of FIG. 1, taken along line 3—3 of FIG. 2.
Figure 4:
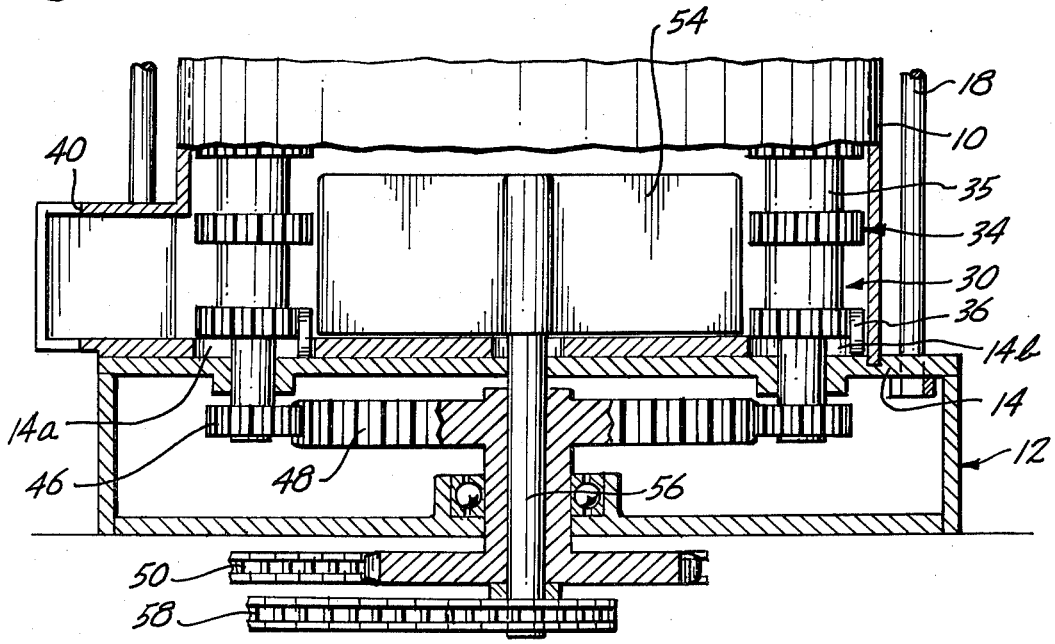
FIG. 4 is a side view in cross section of the base of the comminutor, including the drive mechanism contained therein.

The gear-like clusters 34 of teeth 32 of adjacent rollers 30 are offset axially relative to one another along the shaft portions 35 of the rollers 30 such that serially adjacent pairs of rollers 30 may be positioned sufficiently close to one another that the clusters 34 of teeth 32 of the adjacent rollers 30 are interleaved. In this manner, the outer cutting edge of each tooth 32 extends, during the course of a complete revolution about its associated roller 30, to just short of the shaft portions 35 of the two rollers 30 immediately adjacent and on opposite sides of the associated roller 30. If the vertical dimensions of the prismatically shaped teeth 32 are chosen to be approximately equal to the vertical dimensions of the intervening shaft portions 35 of the rollers 30, the closely interleaved clusters of teeth thereby form an essentially impermeable enclosure boundary through which pieces of solid material may pass only when they have been comminuted to a sufficiently small size to be swept pass the rollers enclosed in the spaces formed between adjacent teeth of a roller. It is found that the practical effect of having such a closely interleaved arrangement of teeth is to comminute solid material to an extremely fine, dust-like consistency that is passed out of the enclosure between the rollers in an airborne state. In practice, however, the clusters of teeth are not quite so closely interleaved in order to maintain an adequately safe mechanical clearance between the oppositely moving teeth of adjacent rollers, as illustrated in FIGS. 1 and 2 of the preferred embodiment. It is nevertheless found that the relatively small fraction of comminuted material which passes out of the enclosure between the rollers is invariably finely reduced to an airborne state. In some applications, it is desirable to obtain a very finely reduced, powdered product, in which case all material is forced to be discharged through and between the rollers 30.

The base plate 14 is formed of relatively thick steel plate that is milled to accommodate the rollers 30 and the cylindrical housing 10. More specifically, an annular recess **14*a* is milled into the top surface of the base plate 14. The outer diameter of the recess 14*a* corresponds with the outer diameter of the housing 10 such that the housing 10 is set into the recess 14*a*** and is rigidly fixed in position thereby.

Additionally, eight circular recesses **14*b* are milled into the top of the base plate 14. The circular recesses 14*b* are centered on the axes of serially alternating ones of the rollers 30. The diameters of the circular recesses 14*b* are approximately equal to the diameters of the circular clusters 34 of teeth 32 on the rollers. The recesses 14*b* are milled to the same depth as and are essentially continuous with the annular recess 14*a*. The inner periphery of the annular recess 14*a* is of a diameter such that the circular recesses 14*b* open outwardly into the annular recess 14*a*. As discussed further below, these circular recesses 14*b* and the annular recess 14*a*** form the primary discharge path for comminuted material leaving the enclosure.

The rollers 30 which are aligned over the recesses **14*b* each include a lowermost cluster 34' of teeth 32 which is positioned immediately above the corresponding circular recess 14*b*, with the lower edges of the teeth 32 positioned at the level of the upper surface of the base plate 14. These lowermost clusters 34' of teeth each include one sweeper tooth 36 that has a greater axial dimension than the other teeth 32 in the lowermost cluster 34', such that the lower portion of each sweeper tooth 36 extends downwardly into the underlying circular recess 14*b*. Each sweeper tooth 36 slidably abuts along its lower edge the bottom surface of its corresponding recess 14*b*. The radial dimensions of the sweeper teeth 36 are the same as the other teeth 32 on the rollers 30, with the result that the sweeper teeth 36 continually revolve within the recesses 14*b* to sweep comminuted material out of the recesses and into the annular recess 14*a*. Additionally, since the circular paths of the sweeper teeth 36 within the circular recesses 14*b* also extend partially into the annular recess 14*a*, the sweeper teeth 36 effectively operate to move comminuted material collected in the annular recess 14*a* in a circular path along the annular recess 14*a* until the material reaches a discharge chute 40 opening from the cylindrical wall of the housing 10. Thus, all comminuted material, whether it passes between the rollers 30 or past the lowermost clusters 34' and into the circular recesses 14*b*, is eventually collected in the annular recess 14*a* and eventually discharged out of the comminuter through the discharge chute 40**.

In other embodiments, the lowermost sets of teeth on the shafts of the rollers may be made somewhat smaller in vertical dimension and set into the circular recesses **14*b* such that the upper edges of the teeth are substantially flush with the surface of the base plate 14. In this configuration, the teeth operate more as a screening element than as a comminuting element, since the outer edges of the teeth do not come into contact with large pieces of material within the enclosure, but rather rotate adjacent the walls of the circular recess 14*b*. There is a significant advantage in this type of configuration in that solid comminuted material may fall downwardly through the gaps between the teeth of the lowermost cluster and are constrained by the walls of the circular recess 14*b*** to continue falling downwardly into the underlying recess and out of the enclosure without being thrown outwardly away from the screening teeth by the rotational motion of the roller. As a result, more efficient and faster discharge of comminuted material is achieved.

The rollers 30 are connected to a gear drive assembly located in the base 12 of the comminuter. The source of power may be of any suitable type, including electric motors and internal combustion engines. As illustrated in FIG. 1, each roller 30 includes a planetary drive gear 46 affixed to its lower end beneath the base plate 14. The drive gears 46 are engaged with a central sun gear 48 which is driven by a belt 50 connected to a motor or other source of power (not shown) external to the base enclosure 12. The drive mechanism is geared to cause all of the rollers 30 to rotate in a common direction, being clockwise as viewed from above in the preferred embodiment, as indicated by the directional arrows 52.

A paddle-like impeller 54 is provided in the center of the enclosure. The impeller 54 is connected to a central rotatable shaft 56 which is driven by a second powered belt 58. The impeller is rotatable at a variable speed independently of the rollers 30. As discussed above, the impeller 54 is employed to augment the action of the rollers 30 in driving solid material orbitally within the enclosure at a speed sufficiently great to ensure that the material is driven against the rollers 30 with sufficient centrifugal force to achieve its comminution on the teeth 32 of the rollers 30.

In operation, material to be comminuted is fed into the comminutor through the infeed chute 26. Upon coming into contact with the rotating teeth of the rollers 30 and the impeller 54, the material is swept in a counterclockwise direction, as viewed from above in the comminutor illustrated in FIG. 1 and as indicated by the directional arrows 52 in FIG. 3. The orbital motion of the material within the enclosure defined by the rollers 30 imparts to the material sufficient angular momentum to be driven outwardly with a substantial centrifugal force. The centrifugal force of the swirling material causes it to be driven outwardly against the teeth 32 of the rollers 30. The material is thereby comminuted and reduced by a puncturing or cutting action against the inwardly directed teeth 32. Additionally, the rotational motion of the teeth 32 causes them to break up the material with a tangential avulsing action, since the teeth 32 are generally moving at a faster tangential speed then the swirling material.

Further, there is an interactive process between immediately adjacent rollers that agitates and further comminutes the solid material. Specifically, solid pieces of material tangentially engaged by the puncturing teeth of one roller are swept into the interstitial or inter-roller space between the immediately adjacent roller, where the oppositely-moving teeth of the adjacent roller engage the object at a relatively higher speed with an avulsing action that drives the object inwardly toward the orbiting mass of material and also imparts a spinning motion to the material. This complex interaction between adjacent rollers generally agitates the orbiting mass of material and results in more effective comminution of relatively smaller pieces of material that are able to fit into the inter-roller spaces.

Upon being comminuted to a sufficiently small size, the material passes through and between the teeth 32 of the lowermost clusters 34' of rollers 30 positioned over the recesses **14*b*. This passage of finely comminuted material out of the bottom of the enclosure is enhanced by a natural sorting action that operates to cause larger pieces of material to migrate toward the top of the enclosure while smaller particle tend to migrate toward the bottom of the enclosure. The underlying physical principle responsible for this sorting migration is not well understood, although it is known to be observed also in other environments wherein particles of varying sizes are agitated in a closed container. Upon passing into the recesses 14*b*, the material is swept outwardly from each recess 14*b* by the sweeper teeth 36 of the lowermost clusters 34' of teeth 32. Also, some comminuted material passes between the adjacent rollers 30 to fall downwardly along the interior surface of the cylindrical housing 10 and into the annular recess 14*a*. The comminuted material is eventually swept along the annular recess 14*a* and discharged through the discharge chute 40**.

Figure 5:
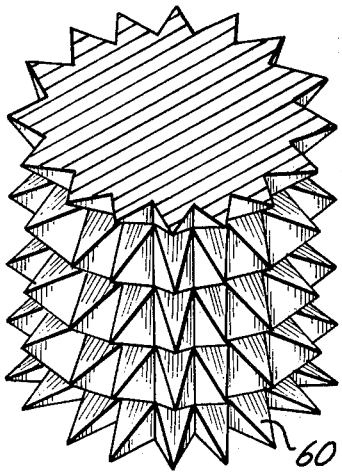
FIGS. 5 through 10 are partial isometric views of comminuting rollers having various alternative types of comminuting elements.
Figure 6:
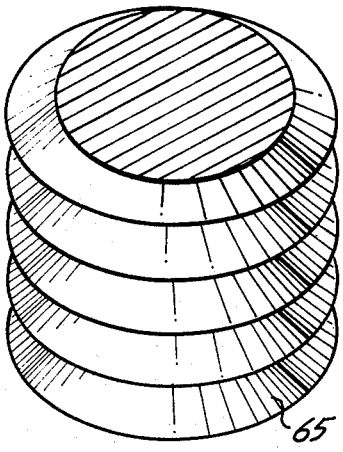
Figure 7:
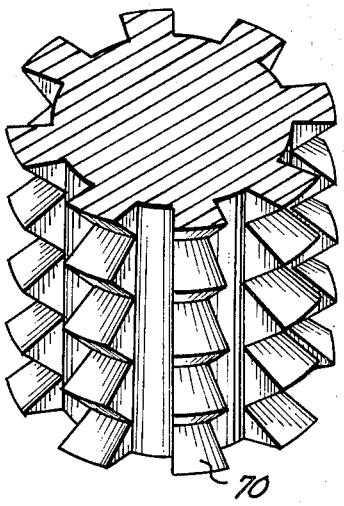
Figure 8:
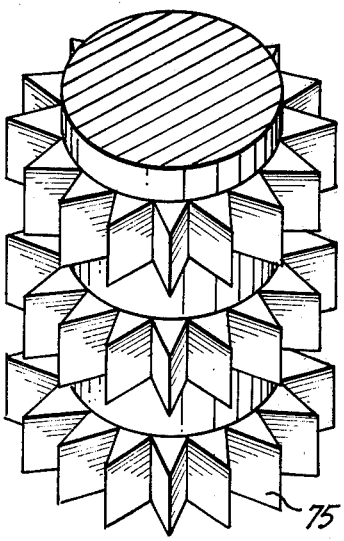
Figure 9:
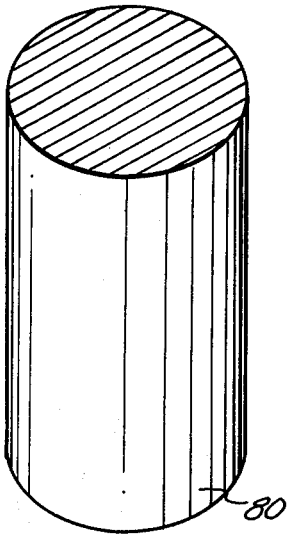
Figure 10:
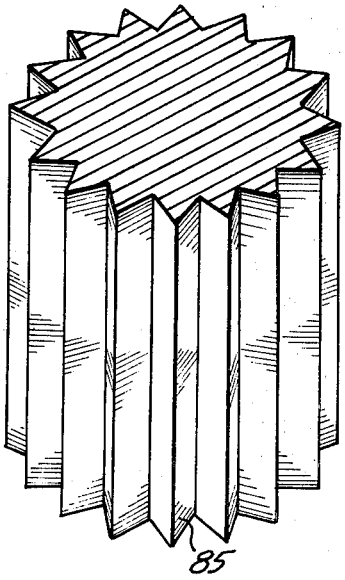

Although the preferred embodiment illustrated in FIGS. 1–4 includes rollers 30 having triangular prismatic teeth 32, other types of cutting members may be used, as illustrated, for example, in FIGS. 5–10. FIG. 5, for example, illustrates rollers having pyramidal pointed teeth 60. FIG. 6 illustrates a roller having disc-shaped cutting blades 65 coaxial with the shaft of the roller. FIG. 7 illustrates a roller having discrete teeth 70 having horizontal or circumferential cutting edges. FIG. 8 illustrates a roller having vertically oriented triangular prismatic teeth 75 much the same as the rollers 30 of the preferred embodiment of FIGS. 1–3 described above. FIG. 9 illustrates a simple roller 80 having a smooth, cylindrical surface. Finally, FIG. 10 illustrates a roller having continuous vertical teeth 85. The various types of rollers illustrated may be employed in different types of comminuting operations. For example, smooth rollers of the type illustrated in FIG. 9 are particularly useful for comminuting stone or gravel since they require little maintenance and have no teeth to become dull.

It is found that in certain applications the teeth of the rollers require essentially no maintenance and, in fact, exhibit a self-sharpening action under certain circumstances. For example, the preferred embodiment of the comminutor of the present invention has been used extensively to comminute wood scrap and has shown essentially no deterioration or dulling of the edges of the cutting teeth. However, even in applications where such a self-sharpening action does not result, the rollers may be readily removed or serviced in place.

The comminutor of the present invention also operates to screen the comminuted product and regulate the grain size of the product. In the preferred embodiment, comminuted particles pass through the recesses **14*b* in the base plate of the comminutor and also pass between the rollers 30 and downwardly along the inside wall of the cylindrical housing 10. It is found that the natural sorting process which takes place inside the comminutor may be usefully exploited to result in selective collection of different size fractions of the comminuted material. Specifically, the types of cutting teeth situated at various heights on the rollers 30** may be varied to achieve different types of puncturing and cutting action at different levels in the comminutor.

It will be noted that overprocessing or repeated processing of material is avoided with the comminutor of the present invention. Particles that are comminuted to a sufficiently small size to pass between the rollers 30 or through the lowermost clusters 34' of teeth 32 are readily passed out of the comminuting enclosure and are not subjected to repeated or further comminuting. On the other hand, particles not sufficiently small to pass between the rollers or into the recesses **14*b* of the preferred embodiment are retained in the enclosure of the comminutor and repeatedly subjected to the comminuting action of the rollers 30** until they are reduced to sizes sufficiently small to pass out of the comminutor.

Figure 11:
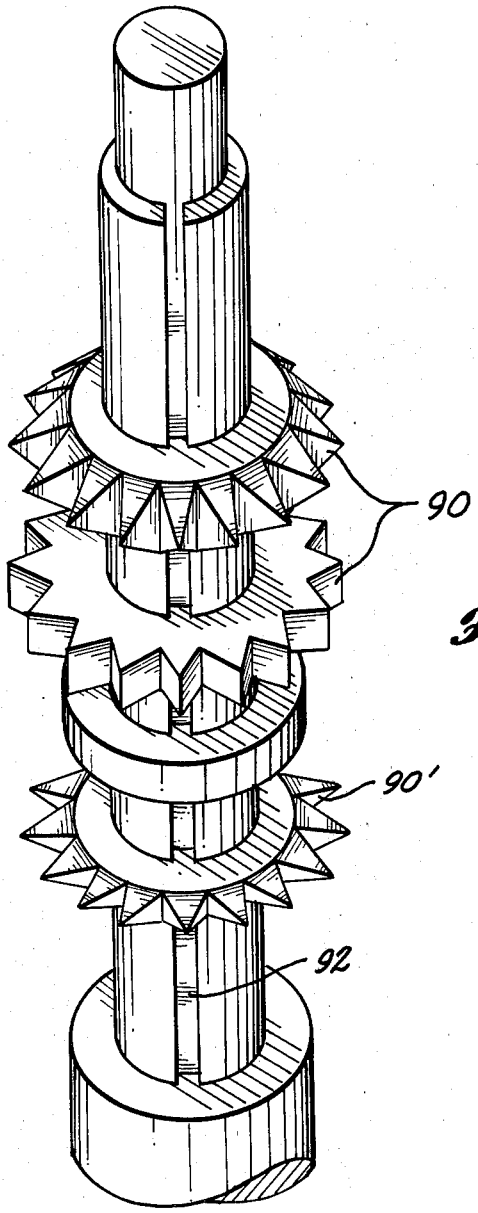
FIG. 11 is an isometric view of a comminuting roller having several different types of comminuting elements keyed to a central shaft, including a lowermost set of teeth that is adaptable to function as a screening disk or element.

As illustrated in FIG. 11, the rollers of the comminutor may be constructed to have interchangeable and removable sets of teeth. The sets of teeth may be formed in integral rings 90. The shaft of the rollers may be provided with a standard keyway 92 such that the sets of teeth may be keyed into position anywhere along the shafts of the rollers with a conventional key device. In this manner, the positions as well as the shapes of the teeth along the rollers may be varied to achieve different processing characteristics.

Also illustrated in FIG. 11 is a lowermost cluster of teeth 90' that is keyed to the shaft of the roller and which is of relatively smaller vertical dimension than the other clusters of teeth. The lowermost cluster 90' could be set into cooperable recesses similar to those shown as **14*b* in FIGS. 1–4** to provide a set of screening teeth recessed into the base of the comminuting enclosure. As mentioned earlier, the advantage of this type of configuration lies in the fact that more efficient and rapid discharge of comminuted material is achieved by reason of the material being able to fall downwardly through the gaps between the teeth without being thrown outwardly away from the discharge opening.

Figure 12:
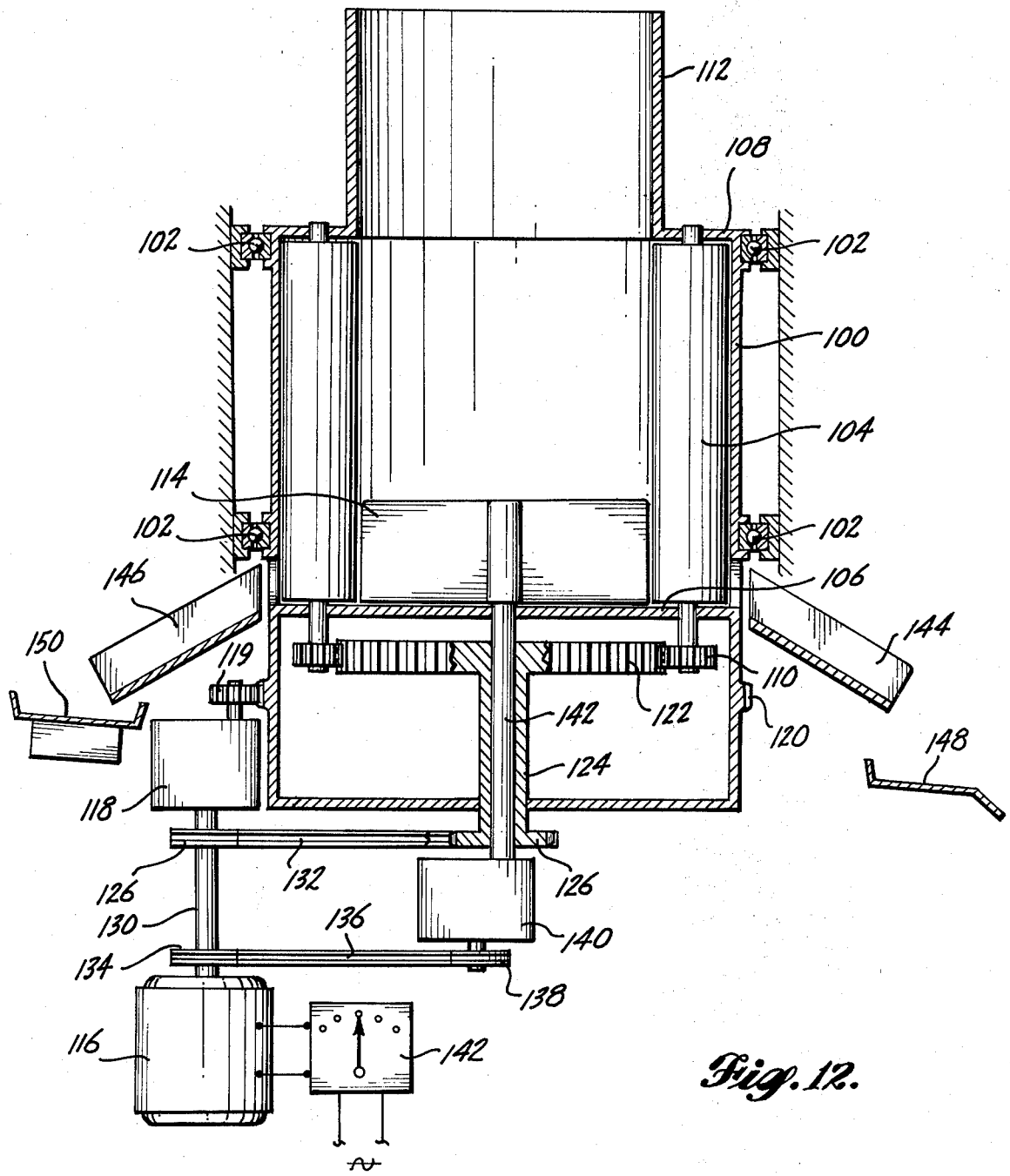
FIG. 12 is a schematic illustration in cross-sectional side view of an alternative embodiment of the invention having comminuting rollers journalled to a rotatable frame.

In FIG. 12, an alternative embodiment of the invention is depicted in schematic form as a composite apparatus having independent speed control provisions for rotating the cylindrical housing itself, for rotating the rollers within the housing and for rotating an impeller within the housing so as to cause orbital motion of the mass of solid material objects to be comminuted. In the illustration a generally tubular outer housing 100 is mounted in an upright position in bearings 102 so as to be roatatable about its central longitudinal axis. Rollers 104 are journalled to an integral base plate 106 and an annular shoulder 108 of the housing 100 for rotational motion. Each roller 104 includes a planetary gear 110 beneath the base plate 106. The housing 100 further includes an integral infeed chute 112 extending upwardly from the annular shoulder 108. The comminuter further includes an impeller 114 centered in the enclosure of the housing 100.

A single motor 116 drives the housing 100, the rollers 104 and the impeller 114 independently. More specifically, the motor 116 drives the housing 100 through a variable speed gear box 118. A spur gear 119 on the output shaft of the gear box 118 is engaged with a ring gear 120 around the rotatable base of the housing 100. The planetary gears 110 of the rollers 104 are geared to a central sun gear 122 attached to a hollow shaft 124. The hollow shaft 124 is connected to a pulley 126 which is in turn connected to a pulley 128 on the output shaft 130 of the motor 116 by means of a belt 132. A second pulley 134 on the output shaft 130 of the motor 116 is connected by means of a belt 136 to a pulley 138 on the input shaft of a second variable speed gear box 140. The output shaft 142 of the second variable speed gear box 140 extends upwardly through the hollow shaft 124 and is connected to the impeller 114. The speed of the motor 116 is regulated by a speed controller 142.

By varying the speed of the motor 116 and the gear ratios of the gear boxes 118 and 140, the rotational speeds of the housing 100, the impeller 114 and the rollers 104 may be varied independently, both absolutely and relatively. Comminuted material discharged between the rollers 104 or through discharge openings in the base of the housing is funneled down chutes 144 and 146 to collection troughs 148 and 150.

As discussed above, the advantage of a comminuter of the type illustrated in FIG. 12 is that the relative puncturing and tearing actions of the comminuting elements of the rollers 104 may be varied to achieve the type of comminuting action appropriate for the material at hand. A low density, fibrous material such as wood scrap is comminuted more efficiently by a relatively greater tearing or avulsing action, whereas a material such as rock is typically comminuted more efficiently by puncturing action of the comminuting elements operating under substantial centrifugal forces so as to fracture the relatively dense and brittle rock.

Although the present invention is described and illustrated in terms of a preferred embodiment and certain alternative embodiments, it will be understood that various modifications, alterations and substitutions which may be apparent to one skilled in the art may be made without departing from the essential spirit of the invention. Accordingly, the scope of the invention is defined by the following claims.

The embodiments of the invention in which an exclusive property or privilege is claimed are defined as follows:

1. An apparatus for reducing solid material objects to particulate form comprising an annular array of substantially parallel rollers forming within the array an enclosure of generally round tubular form adapted to receive the objects, means forming an opening for introducing objects into said enclosure, means to move the objects orbitally around the interior of said enclosure, means mounting said rollers to rotate about substantially parallel axes and operable to roll on the orbiting objects under bearing pressure produced by centrifugal force of the objects, said rollers operating to impact the objects under such bearing pressure to thereby progressively comminute the objects.

2. The apparatus defined in claim 1 wherein the means to move the objects orbitally at least partially comprises power means to rotate the rollers conjointly in a common direction, whereby driving traction thereof against the objects contributes to said orbital motion.

3. The apparatus defined in claim 2 wherein said means forming an enclosure of generally upright tubular form is rotatable about a central upright axis of said enclosure such that said enclosure and said rollers are independently rotatable, and further comprising power means for driving said enclosure in rotational motion.

4. The apparatus defined in claim 3 wherein said rollers have a plurality of object-puncturing elements distributed over the surfaces thereof to penetrate said objects under said bearing pressure to thereby progressively comminute the objects.

5. The apparatus defined in claim 4 wherein at least some of said object-puncturing elements distributed over the surfaces of said rollers comprise rings of teeth arranged in gear-like clusters spaced lengthwise along the rollers, said rollers being of reduced diameter between said clusters of teeth, with clusters of teeth of adjacent rollers being relatively offset along the rollers and said offset clusters of adjacent rollers being mutually interleaved.

6. The apparatus defined in claim 5 wherein said teeth are each of the configuration of an upright triangular prism including an outwardly directed cutting edge oriented substantially parallel to the axis of rotation of its associated roller.

7. The apparatus defined in claim 5 further including a cylindrical housing positioned coaxially around said rollers to collect comminuted material passing between said rollers, said cylindrical housing including an opening for discharging comminuted material.

8. The apparatus defined in claim 4 wherein said rollers and said means forming an enclosure are rotated in opposite directions.

9. The apparatus defined in claim 4 wherein the rollers and the means forming an upright tubular enclosure are independently driven in the same rotational direction.

10. The apparatus defined in claim 2 wherein said rollers have a plurality of object-puncturing elements distributed over the surfaces thereof to penetrate said objects under said bearing pressure to thereby progressively comminute the objects.

11. The apparatus defined in claim 10 wherein at least some of said object-puncturing elements distributed over the surfaces of said rollers comprise rings of teeth arranged in gear-like clusters spaced lengthwise along the rollers, said rollers being of reduced diameter between said clusters of teeth, with clusters of teeth of adjacent rollers being relatively offset along the rollers and said offset clusters of adjacent rollers being mutually interleaved.

12. The apparatus defined in claim 11 wherein said teeth are each of the configuration of an upright triangular prism including an outwardly directed cutting edge oriented substantially parallel to the axis of rotation of its associated roller.

13. The apparatus defined in claim 11 or 12 further comprising a generally cylindrical upright housing coaxially enclosing said rollers and wherein said plurality of rollers includes equal numbers of first rollers and second rollers interposed in a mutually alternating sequence around said cylindrical enclosure, said rollers being journalled in a base plate including an annular recess and a plurality of cylindrical recesses centered on and aligned with said first rollers, said first rollers each including a lowermost cluster of teeth positioned over and adjacent the associated cylindrical recess in said base plate, said lowermost clusters of teeth of said first rollers each including a sweeper tooth extending downwardly into the associated cylindrical recess to slidably abut the bottom surface of the cylindrical recess, said annular recess of said base plate extending inwardly to intersect with said cylindrical recesses whereby comminuted material is passed out of the comminuter by passing into said circular recesses and being swept therefrom into said annular recess and being swept therefrom through a discharge chute connected to and opening from said housing.

14. The apparatus defined in claim 13 wherein the means to move the objects orbitally at least partially comprises a power driven impeller member rotationally mounted within the enclosure to rotate about a central upright axis.

15. The apparatus defined in claim 14 wherein the rollers are driven conjointly in a common direction at a surface speed substantially matching the orbital speed of the objects where they bear on the rollers.

16. The apparatus defined in claim 10 wherein said object-puncturing elements comprise teeth each having the configuration of a triangular prism including an outwardly directed cutting edge oriented substantially parallel to the axis of rotation of its associated roller.

17. The apparatus defined in claim 10 wherein said object-puncturing elements comprise pyramidally shaped teeth pointed radially outwardly from said rollers.

18. The apparatus defined in claim 10 wherein said object-puncturing elements comprise teeth bevelled in planes perpendicular to the axes of the rollers to have circumferentially curved cutting edges.

19. The apparatus defined in claim 10 wherein said object-puncturing elements comprise horizontally oriented disc-shaped cutting elements.

20. The apparatus defined in claim 10 wherein said object-puncturing elements comprise continuous longitudinal cutting edges running the lengths of said rollers.

21. The apparatus defined in claim 1 wherein said rollers are substantially cylindrically shaped.

22. The apparatus defined in claim 21 wherein the means to move the objects orbitally at least partially comprises a power driven impeller member rotationally mounted within the enclosure to rotate about a central upright axis.

23. The apparatus defined in claim 22 further comprising a generally cylindrical housing coaxially enclosing said rollers and wherein said plurality of rollers includes equal numbers of first rollers and second rollers interposed in a mutually alternating sequence around said cylindrical enclosure, said rollers being journalled in a base plate including an annular recess and a plurality of cylindrical recesses centered on and aligned with said first rollers, said first rollers each including a lowermost cluster of teeth positioned over and adjacent the associated cylindrical recess in said base plate, said lowermost clusters of teeth of said first rollers each including a sweeper tooth extending downwardly into the associated cylindrical recess to slidably abut the bottom surface of the cylindrical recess, said annular recess of said base plate extending inwardly to intersect with said cylindrical recesses whereby comminuted material is passed out of the comminuter by passing into said circular recesses and being swept therefrom into said annular recess and being swept therefrom through a discharge chute connected to and opening from said housing.

24. The apparatus defined in claim 22 wherein said rollers have a plurality of object-puncturing elements distributed over the surfaces thereof to penetrate said objects under said bearing pressure to thereby progressively comminute the objects.

25. The apparatus defined in claim 24 wherein at least some of said object-puncturing elements distributed over the surfaces of said rollers comprise rings of teeth arranged in gear-like clusters spaced lengthwise along the rollers, said rollers being of reduced diameter between said clusters of teeth, with clusters of teeth of adjacent rollers being relatively offset along the rollers and said offset clusters of adjacent rollers being mutually interleaved.

26. The apparatus defined in claim 24 further comprising a generally cylindrical upright housing coaxially enclosing said rollers and wherein said plurality of rollers includes equal numbers of first rollers and second rollers interposed in a mutually alternating sequence around said cylindrical enclosure, said rollers being journalled in a base plate including an annular recess and a plurality of cylindrical recesses centered on and aligned with said first rollers, said first rollers each including a lowermost cluster of teeth positioned over and adjacent the associated cylindrical recess in said base plate, said lowermost clusters of teeth of said first rollers each including a sweeper tooth extending downwardly into the associated cylincrical recess to slidably abut the bottom surface of the cylindrical recess, said annular recess of said base plate extending inwardly to intersect with said cylindrical recesses whereby comminuted material is passed out of the comminuter by passing into said circular recesses and being swept therefrom into said annular recess and being swept therefrom through a discharge chute connected to and opening from said housing.

27. The apparatus defined in claim 26 wherein the means to move the objects orbitally at least partially comprises a power driven impeller member rotationally mounted coaxially within the enclosure to rotate about a central upright axis.

28. The apparatus defined in claim 1 wherein said means forming an enclosure of generally upright tubular form is rotatable about a central upright axis of said enclosure such that said enclosure and said rollers are independently rotatable.

29. The apparatus defined in claim 28 wherein the means to move the objects orbitally at least partially comprises a power driven impeller member rotationally mounted within the enclosure to rotate about a central upright axis.

30. The apparatus defined in claim 29 further comprising a generally cylindrical housing coaxially enclosing said rollers and wherein said plurality of rollers includes equal numbers of first rollers and second rollers interposed in a mutually alternating sequence around said cylindrical enclosure, said rollers being journalled in a base plate including an annular recess and a plurality of cylindrical recesses centered on and aligned with said first rollers, said first rollers each including a lowermost cluster of teeth positioned over and adjacent the associated cylindrical recess in said base plate, said lowermost clusters of teeth of said first rollers each including a sweeper tooth extending downwardly into the associated cylindrical recess to slidably abut the bottom surface of the cylindrical recess, said annular recess of said base plate extending inwardly to intersect with said cylindrical recesses whereby comminuted material is passed out of the comminuter by passing into said circular recesses and being swept therefrom into said annular recess and being swept therefrom through a discharge chute connected to and opening from said housing.

31. The apparatus defined claims 1, 2, 10, 21, 23, or 30 wherein said rollers are journalled in a substantially horizontal base plate and wherein said base plate includes discharge openings under and aligned with selected ones of said rollers for discharging comminuted material.

32. The apparatus defined in claim 31 wherein said rollers include screening elements coaxially set into said discharge openings for screening comminuted material passing through said discharge openings.

33. The apparatus defined in claim 28 wherein said rollers are substantially cylindrically shaped.

34. A method of reducing solid material objects to particulate form comprising feeding such objects to a space formed within an annularly arranged succession of rollers turning about mutually substantially parallel axes, moving the objects orbitally around the space with the rollers operable to roll on the orbitary objects under bearing pressure produced by centrifugal force of the objects, and comminuting the objects by impacting the objects on the rollers due to the centrifugal force of the objects.

35. The method defined in claim 34 wherein said objects are subjected to a puncturing and avulsing action by roller surface projections.

36. The method defined in claim 35 in which the objects are orbited about an upright axis parallel to the roller axes.

37. The method defined in claim 36 wherein the rollers are maintained in rotation by the orbiting objects bearing against the same.

38. The method defined in claim 35 wherein the objects are placed in orbital motion at least partially by their contact with said rollers.

39. The method defined in claim 38 wherein the smallest particles being formed are drawn continuously from spaces between the lower ends of the rollers.

40. The method defined in claim 34 wherein the orbital motion of the objects is produced at least in part by mechanically impelling the objects about the axis of orbit.

41. The method defined in claim 34 wherein the orbital motion of the objects is produced at least in part by conjointly rotating the rollers and driving the rollers orbitally under externally applied drive power.

* * * * *

UNITED STATES PATENT AND TRADEMARK OFFICE

CERTIFICATE OF CORRECTION

PATENT NO. : 4,366,928

DATED : January 4, 1983

INVENTOR(S) : John H. Hughes

It is certified that error appears in the above—identified patent and that said Letters Patent is hereby corrected as shown below:

Column 1, line 38, "postion" should be —position—
line 61, "jam" should be —jamming—
Column 4, line 23, "increase" should be —increases—
Column 7, line 14, "feeth" should be —feet—
line 43, "pass" should be —past—
Column 9, line 39, "then" should be —than—

Signed and Sealed this

*Twenty-first* Day of *June 1983*

[SEAL]

*Attest:*

DONALD J. QUIGG

*Attesting Officer*

*Acting Commissioner of Patents and Trademarks*